US006173459B1

(12) United States Patent
Ball

(10) Patent No.: US 6,173,459 B1
(45) Date of Patent: Jan. 16, 2001

(54) CONTROL FOR A BATHTUB WASTE WATER DRAIN

(75) Inventor: William T. Ball, Leawood, KS (US)

(73) Assignee: WCM Industries, Inc., Colorado Springs, CO (US)

( * ) Notice: Under 35 U.S.C. 154(b), the term of this patent shall be extended for 0 days.

(21) Appl. No.: 09/320,025

(22) Filed: May 26, 1999

(51) Int. Cl.[7] ..... E03C 1/24
(52) U.S. Cl. ..... 4/680; 4/683
(58) Field of Search ..... 4/680–694

(56) References Cited

U.S. PATENT DOCUMENTS

| | | | | |
|---|---|---|---|---|
| 1,901,118 | * | 3/1933 | Pope | 4/683 |
| 2,122,620 | * | 7/1938 | Nystrom | 4/683 |
| 4,352,213 | * | 10/1982 | Watts | 4/683 |
| 4,594,738 | * | 6/1986 | Gebert | 4/680 |
| 4,744,108 | * | 5/1988 | Schmidt | 4/685 |
| 5,123,123 | * | 6/1992 | Hart et al. | 4/684 |
| 5,394,572 | * | 3/1995 | Humphreys | 4/683 |
| 5,890,241 | * | 4/1999 | Ball | 4/694 |

FOREIGN PATENT DOCUMENTS

| | | | | |
|---|---|---|---|---|
| 830734 | * | 3/1960 | (GB) | 4/680 |
| 520880 | * | 3/1955 | (IT) | 4/683 |

* cited by examiner

*Primary Examiner*—Charles R. Eloshway
(74) *Attorney, Agent, or Firm*—Zarley, McKee, Thomte, Voorhees & Sease

(57) ABSTRACT

A control for a waste water drain in the bottom of a bathtub which has an overflow port above the drain in the end wall of the bathtub has a vertical drain pipe having upper and lower ends. A first fluid port is located at the upper end of the vertical drain pipe and a second fluid port is located below the first fluid port for connection to a bathtub waste water drain. A valve element is slidably mounted in the vertical drain pipe adjacent the second port and is movable between a lower position to close the second port to fluid flow, and an upper position which will open the second fluid port to fluid flow. An overflow cap is rotatably mounted adjacent the first port. An elongated linkage connects the valve element to the overflow cap so that the rotation of the cap in one direction will raise the valve element to the upper position, and rotation of the cap in the opposite direction will lower the valve element to the lower position. The vertical drain pipe is length adjustable.

17 Claims, 5 Drawing Sheets

CONTROL FOR A BATHTUB WASTE WATER DRAIN

BACKGROUND OF THE INVENTION

Bathtub drains commonly have a closure element therein which can open or close the drain by being lifted manually upward to open the drain or drop to an initial seating position to close the drain. While such drain closures work well, they are not greatly convenient by reason of their being located on the bottom of the tub where the drain is located.

Linkage systems do exist in at least lavatories or the like where the waste water drain is opened or closed through a linkage system wherein the operative mechanism is located above the bottom level of the basin. However, these are not easily adapted to the bathtub environment, and pose at least some problems in maintaining the cleanliness of the fixture around the exposed end of the linkage system where the closure is operated.

Variations in tub dimensions and the like sometimes make the adaptation of linkage systems difficult to install.

It is therefore a principal object of this invention to provide a control for a bathtub waste water drain which is easily accessible to the person using the tub.

A further object of this invention is to provide a control for a bathtub waste water drain which can be easily installed in spite of variations in the dimensions of the tub.

A still further object of the invention is to provide a control for a bathtub waste water drain which can be easily cleansed.

These and other objects will be apparent to those skilled in the art.

SUMMARY OF THE INVENTION

A control for a waste water drain in the bottom of a bathtub which has an overflow port above the drain in the end wall of the bathtub has a vertical drain pipe having upper and lower ends. A first fluid port is located at the upper end of the vertical drain pipe and a second fluid port is located below the first fluid port for connection to a bathtub waste water drain.

A valve element is slidably mounted in the vertical drain pipe adjacent the second port and is movable between a lower position to close the second port to fluid flow, and an upper position which will open the second fluid port to fluid flow.

An overflow cap is rotatably mounted adjacent the first port. An elongated linkage connects the valve element to the overflow cap so that the rotation of the cap in one direction will raise will raise the valve element to the upper position, and rotation of the cap in the opposite direction will lower the valve element to the lower position. The vertical drain pipe is length adjustable.

DESCRIPTION OF THE PREFERRED EMBODIMENT

Figure 6:
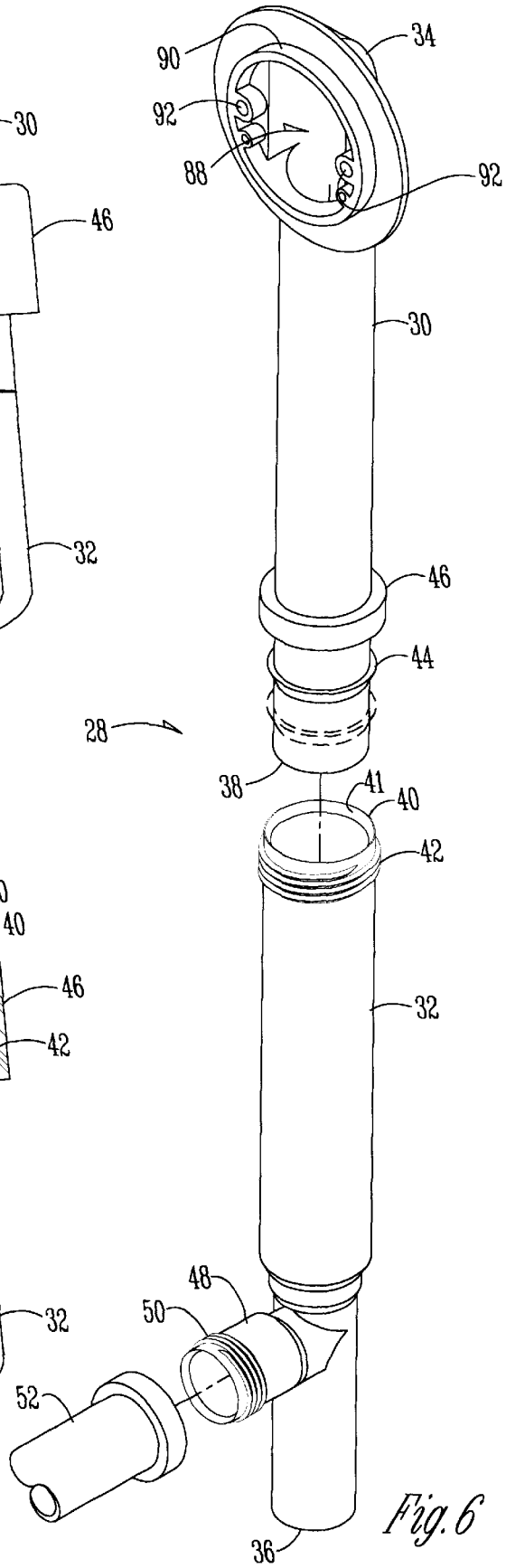
FIG. 6 is an exploded perspective view of the pipe components of the invention.

A bathtub ("tub") 10 is mounted adjacent bathroom end wall 12 and sidewall 14, and has a bottom 16, top end wall 18, and top sidewall 20. A conventional tub waste water drain outlet 22 is located in bottom 16. A conventional water control valve 24 and water outlet 26 are mounted on the end wall 12. With reference to FIG. 6, a vertical drain pipe 28 has an upper portion 30 and a lower portion 32, and an upper end 34 and a lower end 36. The lower end 38 of the upper portion 30 is insertable in the upper end 40 of the lower portion 32. It should be noted that the upper end 40 is tapered around its inner edge 41. Exterior threads 42 extend around the upper end 40.

A tapered plastic seal ring 44 is slidably mounted on upper portion 30 and has a tapered lower edge 45 which is compatible with the tapered inner edge 41 of the lower portion 32. A lock connector nut 46 is slidably mounted on upper portion 30. When the seal 44 is located in the desired position on upper portion 30, its lower end 38 is inserted into the upper end 40 of the lower portion 32 so that the seal ring 44 rests with its tapered surface 41 in engagement with the tapered surface 45 on the upper edge of the member 32. (See FIG. 5). The nut 46 is tightened on threads 42.

A waste water port 48 (FIGS. 6 and 7) is integrally formed with the lower portion 32 and extends horizontally outwardly from portion 32. The outer end of port 48 has external threads 50 thereon which can be detachably and threadably secured to horizontal waste water line 52 (FIG. 6) which is conventionally connected to the waste water drain 22 in tub 10.

Figure 1:
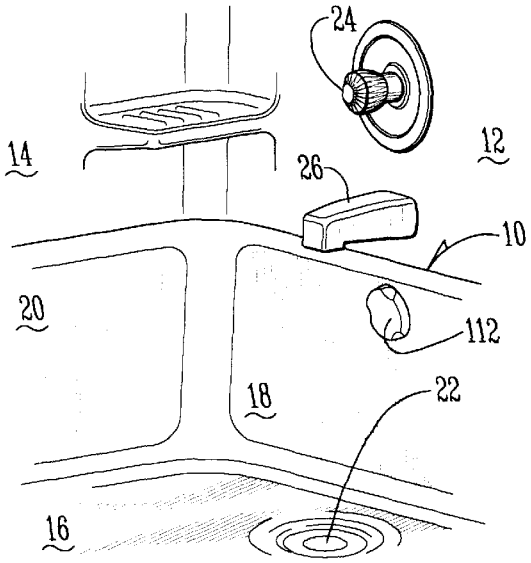
FIG. 1 is a partial perspective view of a tub having the waste water control of this invention.
Figure 3:
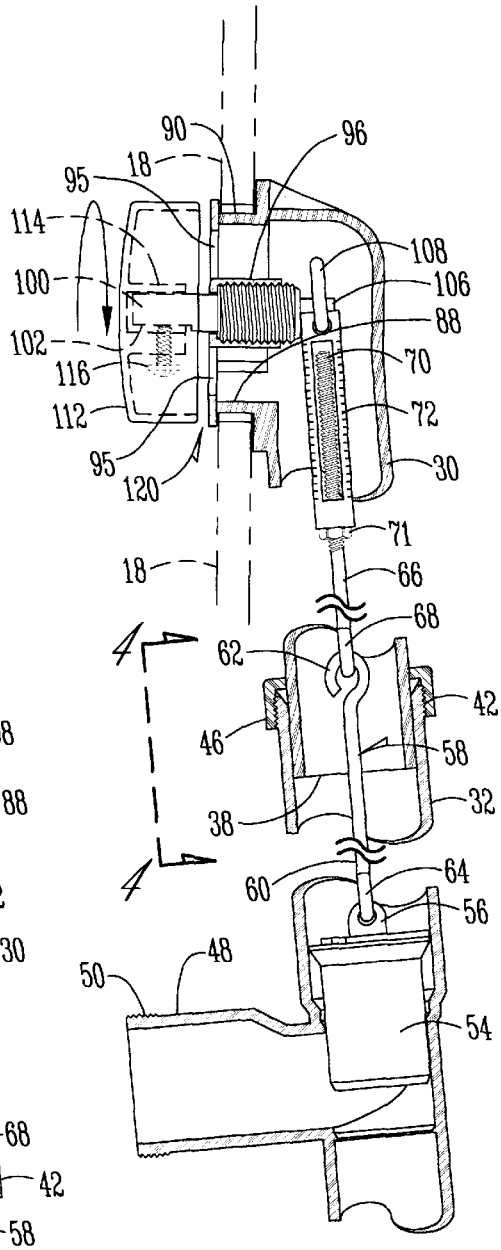
FIG. 3 is a sectional view similar to that of FIG. 2 but shows the valve in an open position.
Figure 2:
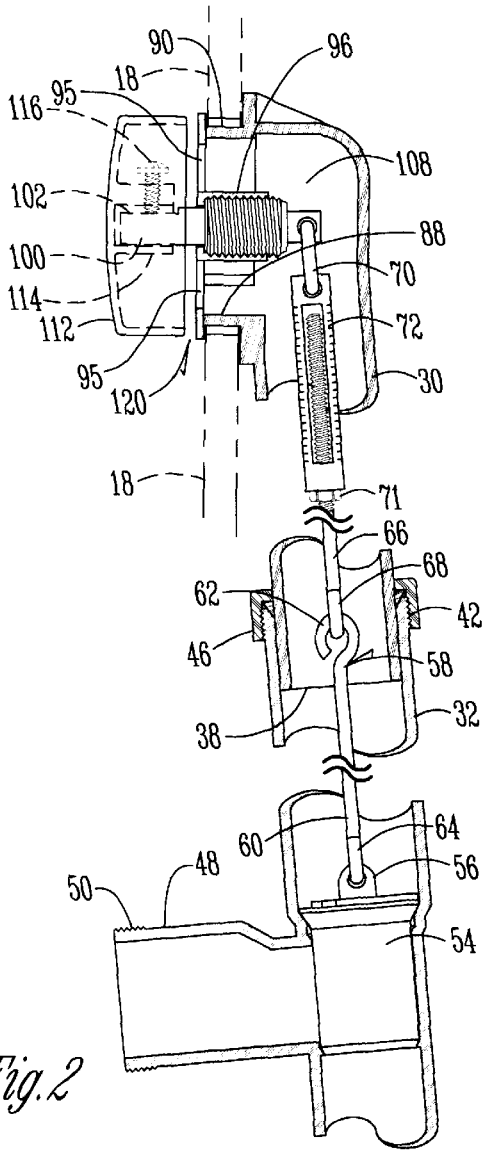
FIG. 2 is an enlarged scale sectional view of the device of this invention showing the valve in the closed condition.
Figure 4:
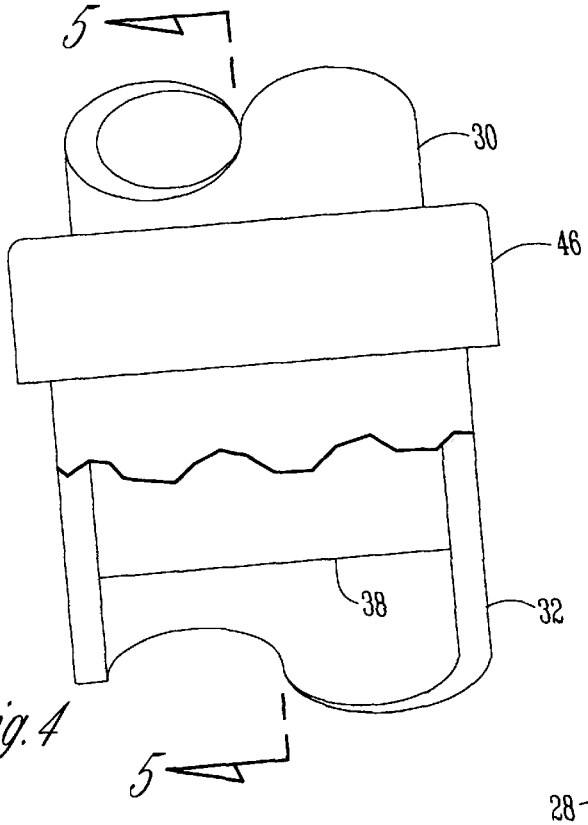
FIG. 4 is an enlarged scale elevational view taken on line 4—4 of FIG. 3.

A valve element or drop cylinder 54 which is of hollow construction is slidably mounted in the vertical drain 28 within lower portion 32 (FIGS. 2 and 3). An ear 56 (FIG. 3) is secured to the upper end of valve element 54. Linkage 58 includes a lower link 60 which has a hook 62 on its upper end and a hook 64 on its lower end. Linkage 58 also includes a threaded link 66 which has a hook 68 on its lower end opposite the threaded upper end 70.

Figures 7, 8, 9:
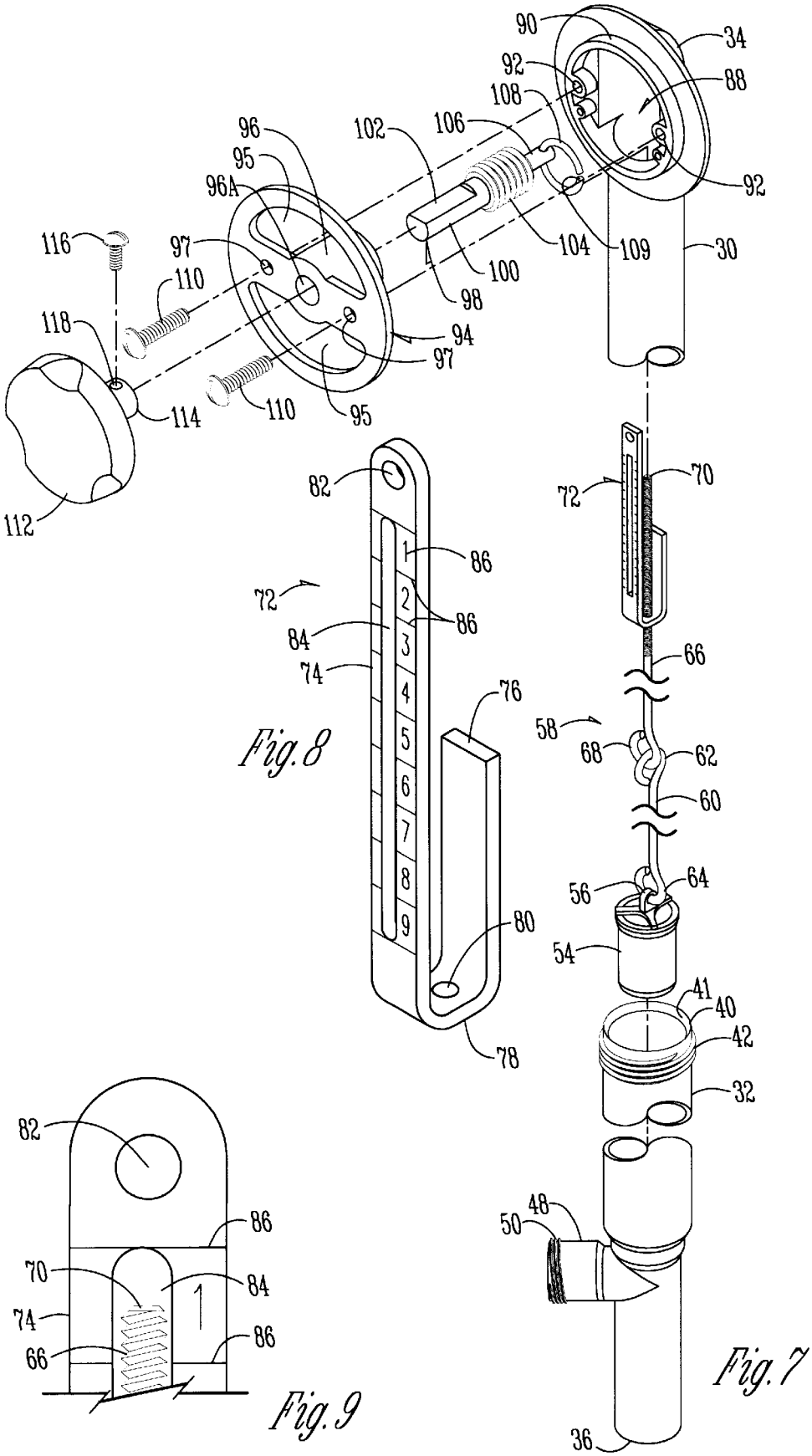
FIG. 7 is an exploded view of the various components of the invention.
FIG. 8 is an enlarged scale perspective view of the gauge used in adjusting the length of the linkage systems.
FIG. 9 is an enlarged scale perspective view of the top of FIG. 8.

Again, with reference to FIGS. 2, 3 and 7, a U-shaped gauge 72 having opposite legs 74 and 76 joined by a bottom 78. The threaded link 66 extends through threaded aperture 80 in the bottom 78. An aperture 82 (FIG. 8) appears at the top of gauge 72. An elongated vertical slot 84 is formed in gauge 72 with a plurality of spaced indica marks 86 appearing adjacent the slot (FIG. 8).

An upper port 88 is formed in the vertical drain pipe 28 (FIG. 6) and is encircled by flange 90. Screw sockets 92 are formed on opposite sides of the port 88.

With reference to FIG. 7, a plate or ring 94 having openings 95 therein has a hub 96 with a threaded bore 96A therein. Screw apertures 97 are located in ring 94, as will be discussed hereafter. An elongated pin 98 has an outer end 100, with a flat portion 102 formed thereon. The threaded center portion 104 on pin 98 is threadably received in the threaded center bore of hub 96 as shown in FIGS. 2 and 3. The inner end 106 of pin 98 is of smaller diameter than portion 100, and has a ring 108 placed in a suitable aperture therein and is fixed in a position that the plane of the ring extends laterally with respect to the longitudinal axis of the pin. The ring 108 is received in the aperture 82 in the upper end of gauge 72.

Screws 110 extend through the openings 97 in ring 94 and are mounted within screw sockets 92 to create the assembly of these components shown in FIGS. 2 and 3.

An overflow plate 112 has a hollow hub 114 which is secured to the outer end 100 of pin 98 by screw 116. The outer end 100 of pin 98 extends through the aperture 118 in hub 114. A space for fluid flow 120 (FIGS. 2 and 3) appears between overflow plate 112.

To install the apparatus of this invention, the vertical distance between the center of the port 88 at the upper end of the vertical drain pipe down to the level of the waste water line 52 (FIG. 6) is measured. This measurement is useful for determining the overall assembled vertical length of the upper portion 30 to the lower portion 32 of the drain pipe 28. In addition, this dimension is also important in determining and adjusting the length of linkage 58 so that the valve member 54 will easily function between the lower position of FIG. 2 and the upper and open position of FIG. 54.

Figure 5:
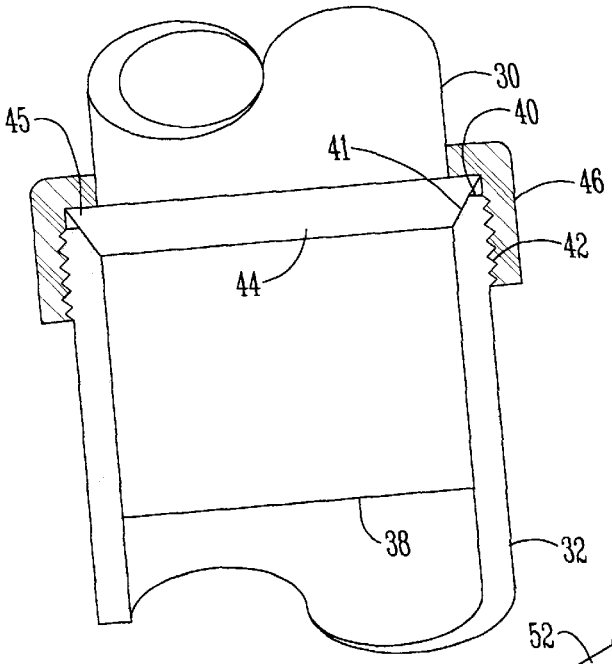
FIG. 5 is a sectional view taken on line 5—5 of FIG. 4.

The overall length of vertical drain pipe 28 is governed by the assembly of the upper portion 30 into the lower portion 32 in the manner described. This adjustment is accomplished by placing the seal 44 in the proper position so that when it rests within the upper end 40 of the lower portion 32, the vertical length will be correct. The juncture then between the portions 30 and 32, as best shown in FIG. 5 and as described above, can be implemented.

However, before this is accomplished, the dimension must be utilized in adjusting the overall length of the linkage 58. If the installer compares the existing unadjusted length of the linkage 58 to the measured vertical distance between the waste drain 52 and the center of port 88, and if the overall length of the linkage, including the gauge 72, is either long or short, the link 66 can be threaded through the threaded bore 80 in the bottom of gauge 72. Nut 71 bears against the bottom 78 of the gauge 72 and determines the relative length of the portion of link 66 between bottom 78 and the cylinder 54. Thus, the cylinder 54 can be raised or lowered with respect to the gauge 72.

By removing set screw 116, the cap 112 can be removed as shown in FIG. 7. By loosening screws 110, the ring 94 can be dismantled from screw sockets 92, thus exposing the upper end and the aperture 82 of gauge 72 as it is pushed upwardly through portion 30. By utilizing a gap 109, in ring 108, the ring can be inserted through the aperture 82 at the top of the gauge, and the gauge and the linkage can be suspended from the laterally extending ring 108. With the ring and the gauge in a three o'clock position, the cylinder 54 would normally be in its lower condition as sown in FIG. 2 whereupon the waste water port 48 would be closed. When the ring 94 and cap 112 are reassembled as described above, the linkage 58 is of a proper length and the assembled condition of vertical drain pipe 28 corresponds thereto.

To open the waste water port 48, the cap 112, as shown in FIG. 7, and upon assembly thereof, can be rotated in a counter-clockwise direction which will permit ring 108 to pull gauge 72 and the linkage and the cylinder 54 attached thereto from the closed position as shown in FIG. 2 to the open position shown in FIG. 3.

In the remote event that the water from water outlet 26 runs into the tub while the valve element 54 is in the closed condition of FIG. 2, water will rise within the tub 10 and will move into vertical drain pipe 28 through port 88 by entering the port through the passage 120 shown in both FIGS. 2 and 3. In that regard, the cap 112 in its spaced relationship from ring 94 functions as a conventional overflow outlet. The water descends downwardly in that case through vertical drain pipe 28 and moves through the hollow cylinder 54 to move vertically downwardly towards the bottom end 36 of portion 32 which is connected to a sewer pipe.

The indica marks 86 on gauge 72 as best shown in FIG. 8, serve as a convenient guide for the installer to use in adjusting the length of linkage 58. Thus, if the top of the link 66 as shown in FIG. 9 needs to be raised approximately ⅛ of an inch, and if the vertical distance between indica marks 86 in FIG. 9 are ¼ inch apart, the installer can look through the slot 84 and visually observe the top 70 of link 66 and determine that the link has been rotated sufficiently to raise is ⅛ of an inch.

DESCRIPTION OF ALTERNATE EMBODIMENT

FIGS. 10–14 disclose an alternate form of the invention. The same numerals are used in FIGS. 10–14 which are common to those parts in FIGS. 1–9.

Figure 10:
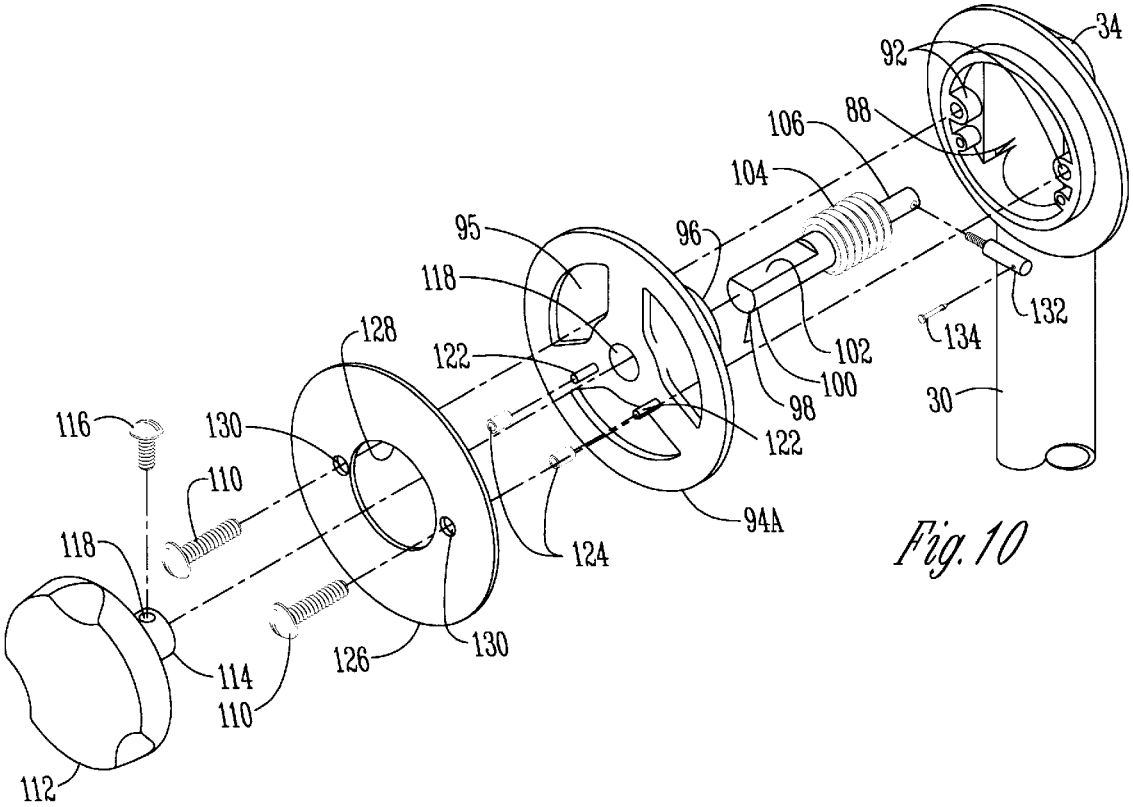
FIG. 10 is an exploded perspective view of an alternate form of the invention.
Figure 11:
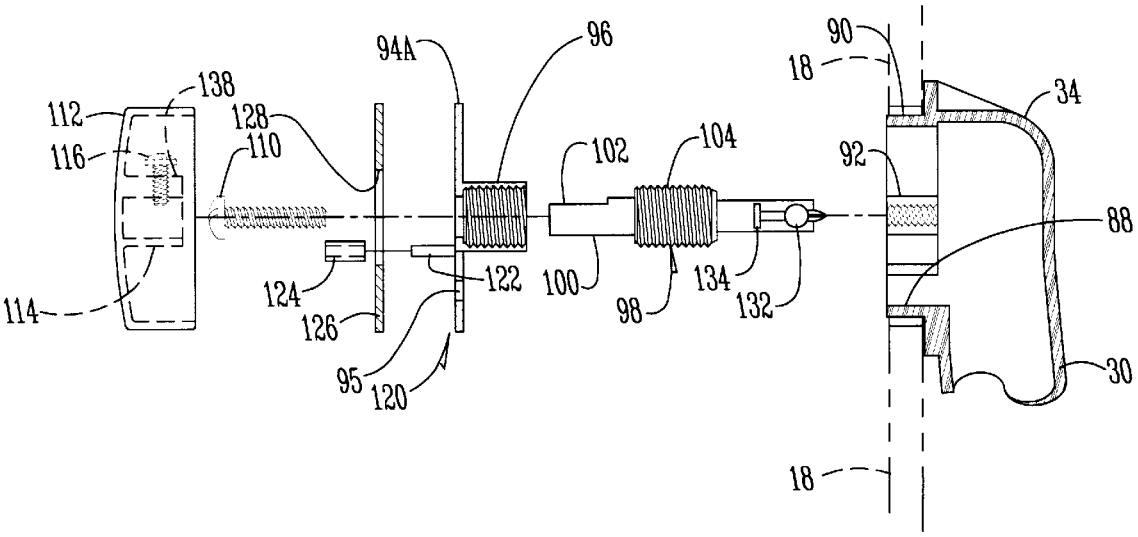
FIG. 11 is an exploded sectional view of the parts of FIG. 10 in a partially assembled condition.
Figure 12:
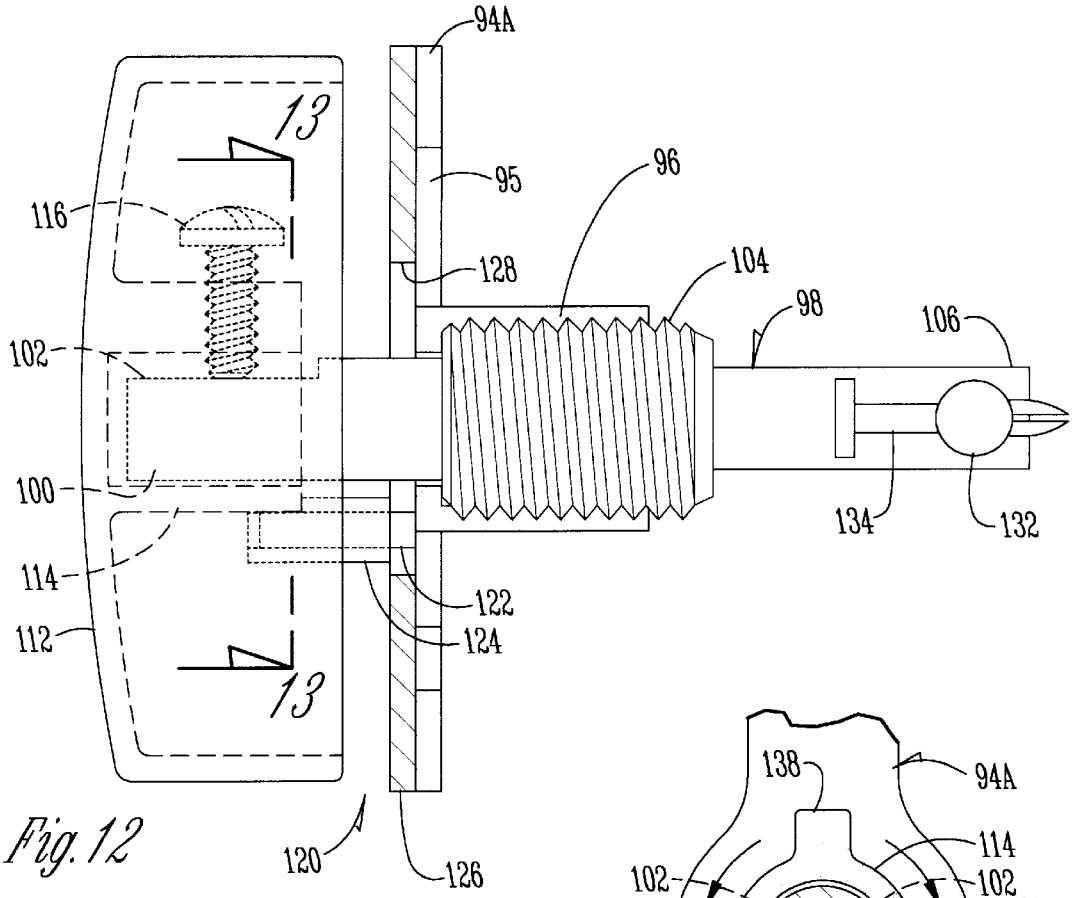
FIG. 12 is an enlarged scale sectional view of the assembled components of FIGS. 10 and 11.
Figure 13:
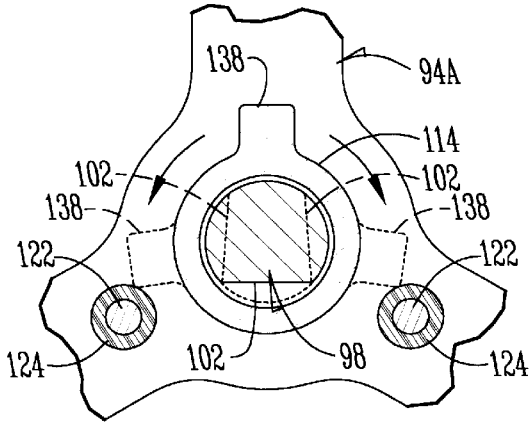
FIG. 13 is a sectional view taken on line 13—13 of FIG. 12.
Figure 14:
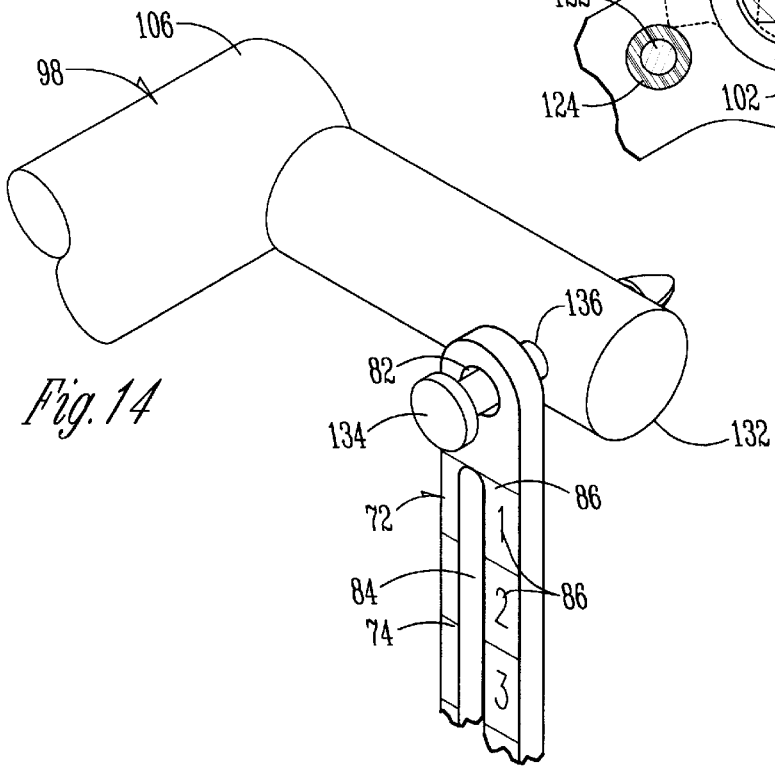
FIG. 14 is an enlarged scale perspective view of the linkage between the gauge and the lifting mechanism.

With reference to FIGS. 10, 11, and 12, the upper portion of pipe 28, upper end 34, flange 90, screw sockets 92, port 88, pin 98 and portions thereof, screws 110, overflow plate 112, are all similar to the same components shown in FIG. 7. The plate 94A in FIG. 10 is similar to the plate 94 in FIG. 7 except that it has two stop pins 122 (FIG. 10) extending towards plate 112 with plastic covers 124 thereon. As shown in FIG. 13, pins 122 are located at about 5 o'clock and 7 o'clock positions with respect to aperture 118.

Plate 126 is mounted on plate 94A which has a center opening 128 and bolt holes 130 to receive bolts 110 which extend through holes 130, thence through opening 95 in plate 94A for threaded attachment in bolt sockets 92 (FIG. 10).

The pin 98 has an outwardly extending arm 132 (FIG. 14) secured thereto at its end 106. A snap pin 134 extends through aperture 136 in the outer end of arm 132, and through aperture 82 in gauge 72. Thus, when plate 112 is rotated, pin 98 is rotated about the longitudinal axis to rotate laterally extending arm 132 which raises or lowers gauge 72. This action raises or lowers the drop cylinder 54 as in the preferred embodiment.

With reference to FIGS. 12 and 13, a shoulder 138 is formed on hub 114 which engages one or the other of stop pins 122 to limit the rotation of plate 112. This in turn limits the rotation of arm 132 wherein the cylinder 54 can be moved between the open or closed portions of FIGS. 3 and 2, respectively.

From the foregoing, it is seen that this invention provides a control for a bathtub waste water drain which is easy to install, refined in appearance, and fairly effective in its operation. As such, the objectives of this invention are fully met.

What is claimed is:

1. A control for a waste water drain in the bottom of a bathtub having an overflow fluid port above the drain in an end wall of a bathtub, comprising;

a vertical drain pipe having upper and lower ends, a first fluid port at the upper end of the vertical drain pipe, a second fluid port below the first fluid port for connection to a bathtub waste water drain, valve element slidably mounted in the vertical drain pipe adjacent the second port and movable between a lower position to close the second port to fluid flow, and an upper position which will open the second port to fluid flow, a plate having a threaded bore secured to the upper end of the vertical drain pipe, an elongated pin having unthreaded inner and outer ends with a threaded center portion threadably mounted in the threaded bore of the plate, an overflow cap mounted on the outer end of the pin, and elongated linkage connecting the valve element to the inner end of the pin so that rotation of the cap and pin in one direction will raise the valve element to the upper position, and rotation of the cap in an opposite direction will lower the valve element to the lower position.

2. The control of claim 1 wherein the vertical drain pipe is length adjustable.

3. The control of claim 1 wherein the vertical drain pipe is comprised of upper and lower portions that are detachably secured to each other.

4. The control of claim 3 wherein a lower end of the upper portion is slidably received within an upper end of the lower portion, and a rotatable slide lock means detachably holds the upper and lower portions in locked relation to each other.

5. The control of claim 4 wherein a seal ring is slidably mounted on the lower end of the upper portion and is engagable with the upper end of the lower portion to seal the upper and lower ends of the lower and upper portions, respectively, together when the rotatable slide lock means creates a locking relation to the upper and lower portions.

6. The control of claim 1 wherein the linkage includes a length adjustable gauge to permit the operational length of the linkage to be length-adjustable.

7. The control of claim 6 wherein the gauge includes an indicia bracket with indicia marks thereon threadably mounted upon one end of a threaded link so that upon the installation of the control, threaded displacement of the link with respect to the gauge can be visually ascertained from indicia marks on the gauge.

8. The control of claim 7 wherein the gauge includes an elongated slot with indicia marks being located adjacent the slot, a threaded nut mounted adjacent to one end of the slot with the one end of the link extending through the nut, and one end of the link being visible through the slot for permitting the amount of longitudinal displacement of the link to be visually ascertained by reference to the indicia marks and the one end of the link.

9. The control of claim 1 wherein the linkage is eccentrically pivotally secured by an upper end to the cap, and pivotally secured by a lower end to the valve element.

10. The control of claim 9 wherein the linkage has a pivotal connection between its upper and lower ends.

11. The control of claim 1 wherein the valve element is a cylinder slidably mounted in the vertical drain pipe.

12. The control of claim 11 wherein the cylinder is hollow so as to always permit fluid flow downwardly through the vertical drain pipe.

13. The control of claim 1 wherein a space exists between the cap and the first port so that fluid can pass through the space and the first port to the interior of the vertical drain pipe.

14. The control of claim 1 wherein the valve element is hollow so as to always permit fluid flow downwardly through the vertical drain pipe.

15. The control of claim 1 wherein the elongated linkage is eccentrically secured to the pin so that when the overflow cap is rotated, vertical movement will be imparted to the elongated linkage.

16. The control of claim 15 further including stop elements so positioned to permit the overflow cap to be rotated to raise or lower the elongated linkage so that the valve element can be moved between the open and closed positions.

17. A drain closure control and a bathtub comprising a bathtub having an interior end wall with interior and exterior ends, and a bottom drain, a fluid overflow port in the end wall above the bottom drain, a vertical drain pipe having upper and lower ends extending downwardly from the overflow port on the interior side of the end wall to a position below the bottom drain, a substantially horizontal drain pipe extending from the bottom drain to the vertical drain pipe and being in fluid communication therewith, a drop cylinder slidably mounted in the vertical drain pipe adjacent the juncture between the horizontal drain pipe and the vertical drain pipe and being movable between a lower position which closes the horizontal drain pipe, and an upper position which will allow fluid to flow through the horizontal drain pipe and thence downwardly into the vertical drain pipe, a plate having a threaded bore secured to the upper end of the vertical drain pipe, an elongated pin having unthreaded inner and outer ends with a threaded center portion threadably mounted in the threaded bore of the plate, an overflow cap mounted on the outer end of the pin and covering the overflow port, elongated linkage connecting the drop cylinder and the inner end of the pin so that rotation of the overflow cap in one direction will raise the drop cylinder to the upper position, and rotation of the overflow cap in the other direction will lower the drop cylinder to the lower position.

* * * * *